United States Patent [19]

Holt et al.

[11] 4,386,486

[45] Jun. 7, 1983

[54] COVER FOR CONCRETE VOIDS OF LIFTING INSERTS

[75] Inventors: Neil L. Holt, Foster City; William G. Olsen, Santa Ana, both of Calif.

[73] Assignee: The Burke Company, San Mateo, Calif.

[21] Appl. No.: 253,592

[22] Filed: Apr. 13, 1981

[51] Int. Cl.[3] ..... F04G 21/00; F04G 21/12; B66C 1/66

[52] U.S. Cl. ..... 52/125.5; 52/127.7; 52/514; 52/701; 52/716

[58] Field of Search ..... 52/124.2, 125.4, 125.5, 52/127.7, 514, 221, 716, 701; 49/463, 464, 465, 466; 220/3.8

[56] References Cited

U.S. PATENT DOCUMENTS

| | | | |
|---|---|---|---|
| 1,970,860 | 8/1934 | Lowell | 52/125.4 |
| 3,200,551 | 8/1965 | Jakeway | 52/717 X |
| 3,531,068 | 9/1970 | Fischer | 52/701 X |
| 4,270,328 | 6/1981 | Page et al. | 52/717 X |

FOREIGN PATENT DOCUMENTS

| | | | |
|---|---|---|---|
| 1137098 | 9/1962 | Fed. Rep. of Germany | 220/3.8 |
| 1475335 | 2/1967 | France | 220/3.8 |
| 353886 | 6/1961 | Switzerland | 52/514 |
| 414977 | 8/1934 | United Kingdom | 52/288 |

*Primary Examiner*—Alfred C. Perham
*Attorney, Agent, or Firm*—Naylor, Neal & Uilkema

[57] ABSTRACT

A plug frictionally fits within the lifting eye of an anchor insert of a tilt-up wall slab. The plug is provided with pin receiving passageways whereby a pin-bearing cover plate may be attached to the plug to cover over the access recess to the anchor insert.

8 Claims, 6 Drawing Figures

COVER FOR CONCRETE VOIDS OF LIFTING INSERTS

CROSS-REFERENCE TO RELATED APPLICATION

Co-pending application Ser. No. 199,944, filed Oct. 23, 1980, for Lift System for Tilt-Up Walls discloses an environment for use of the present invention, i.e. a cover plate system for the lifting anchor recess which normally remains exposed after a tilt-up concrete wall has been erected.

BACKGROUND OF THE INVENTION

1. Field of the Invention

The field of the invention is cover plates for wall openings.

2. Description of the Prior Art

Applicants are unaware of any prior art.

SUMMARY OF THE INVENTION

Recesses or voids are provided for access to anchor inserts in tilt-up wall slabs. Once the wall slabs have been erected, the recesses or voids remain visible.

The present invention has for its essential object the provision for such recesses of closure plates and connector means for the connection of the plates to the anchor inserts within the recesses.

Other objects and advantages of the invention will be apparent from the following description taken in conjunction with the drawing forming part of this specification.

DESCRIPTION OF THE PREFERRED EMBODIMENT

Figure 1:
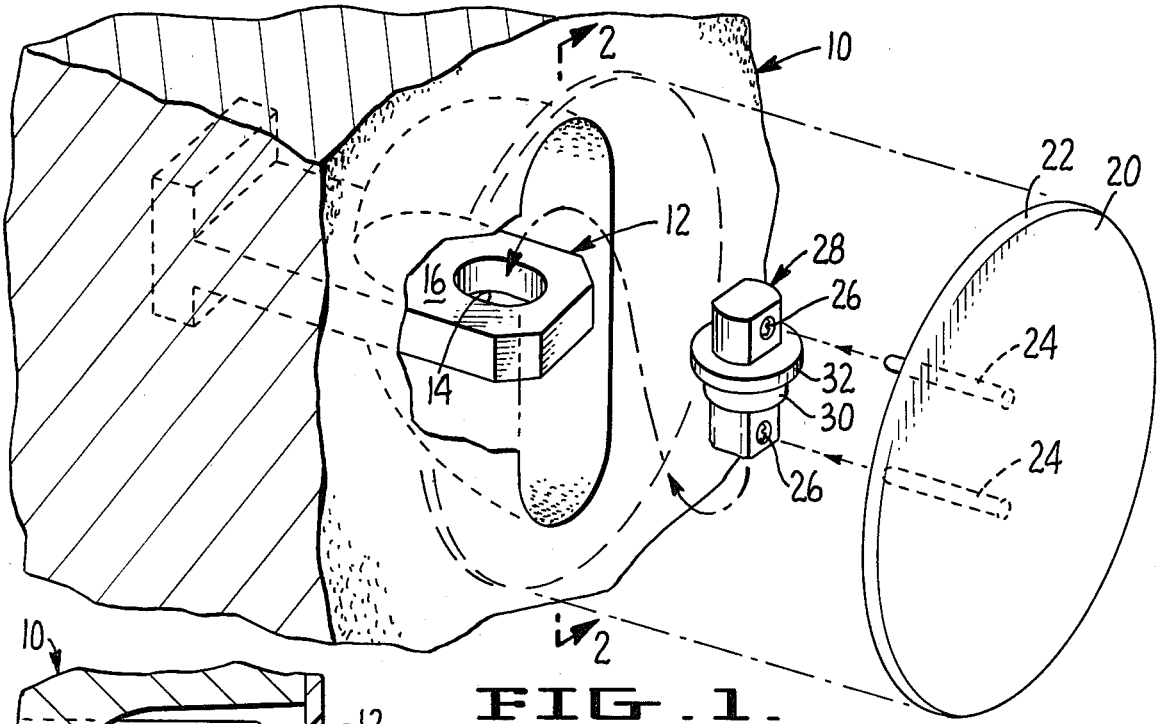
FIG. 1 is an exploded view in perspective showing a wall slab, anchor insert, and the closure plate and connector means of the invention.
Figure 3:
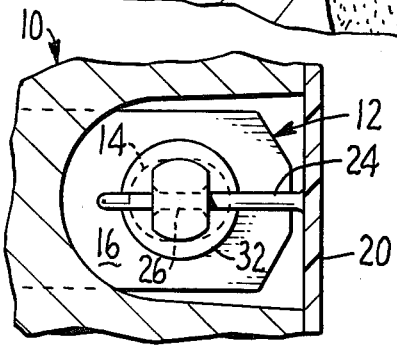
FIG. 3 is a view taken along lines 3—3 of FIG. 2.
Figure 4:
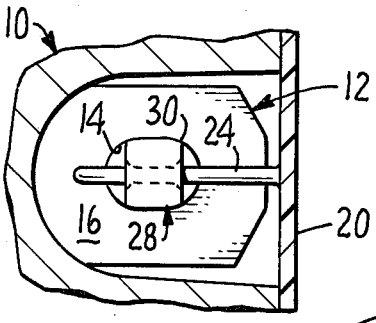
FIG. 4 is a view taken along lines 4—4 of FIG. 2.
Figure 2:
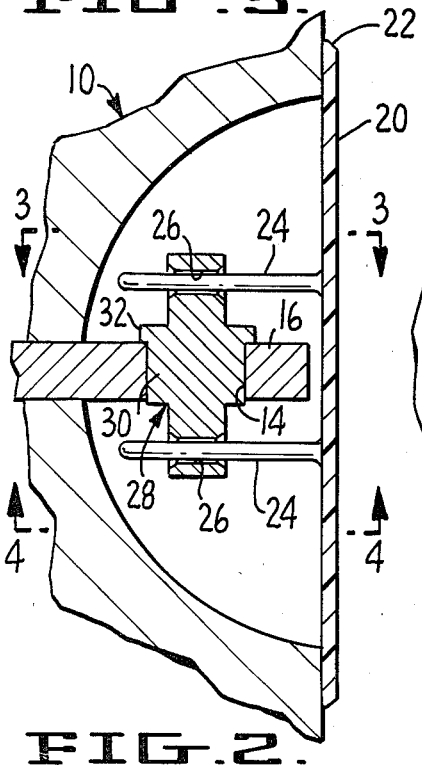
FIG. 2 is a view taken along lines 2—2 of FIG. 1.
Figure 6:
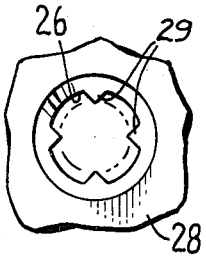
FIG. 6 is an enlarged detail view of one of the pin receptor passageways forming part of the connector means.
Figure 5:
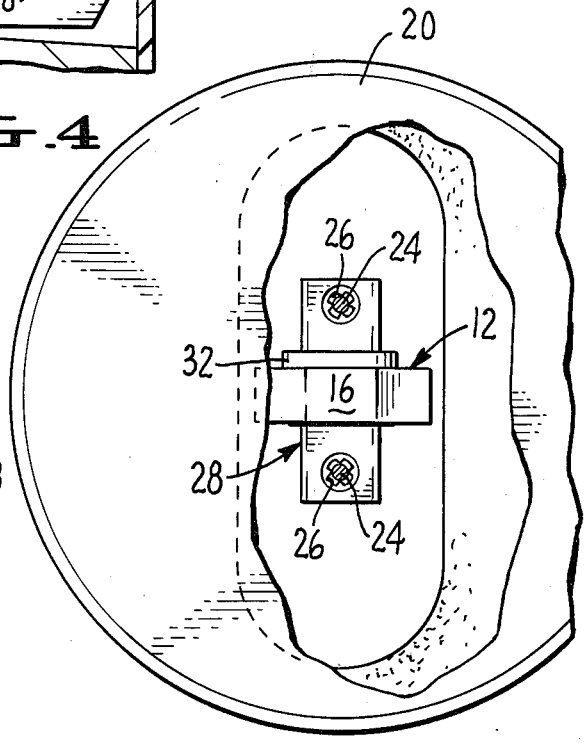
FIG. 5 is a view in front elevation of a closure plate installation, with the closure plate being partially broken away to show internal connector system details.

Concrete wall slab 10 of the tilt-up type is provided with a steel anchor insert 12 provided with an elliptical eye 14 for the attachment to the slab of hoisting mechanism, all such as shown and described in the above-identified co-pending application. When the slab is positioned on the ground prior to the tilt-up operation, the elongated stem portion 16 of the insert extends vertically. After the slab has been erected, the stem 16 of the insert is horizontally oriented, as in FIG. 1.

A recess 18 is formed in the slab for access of the hoisting mechanism, not shown, to anchor insert 12. The object of the invention is to furnish a closure plate for this recess and to provide for a tight and quick fitting connection between the closure plate and the anchor insert. The closure plate 20 is provided with a tapered peripheral edge 22 and with a pair of pins 24. The pins 24 are tightly fitted within passageways 26 formed in connector plug 28. The passageways 26 are provided with longitudinally tapered ridge elements 29 which are adapted to bite into and tightly engage the pins 24.

Plug 28 is provided with an elliptical body portion 30 which is complemental in shape to the elliptical eye 14 of the anchor insert, and plug 28 is also provided with a flange 32 which is adapted to abut insert 12.

Plate 20 and pins 24 are preferably molded in one piece from tough, flexible plastic. Plug 28 is preferably molded from the same material.

The pins 24 extend almost to the inner end of the recess 18 to ensure that they will extend completely through the passageways 26. The distance of these passageways from the outer face of the slab 10 will vary from slab to slab due to the fact that the depths of the anchor inserts within the tilt-up slabs will vary to some degree from slab to slab.

The circular plate or cap 20 is made large enough to completely cover the recess 18 even though the centers of the plate and recess may not be in registry.

The plate 20 is made flexible enough so that it will bend to seat flush with the concrete surface of the slab. The very strong frictional holding action between the pins 24 and the passageways 26 of plug 28 also facilitates the seating flush of the plate with the concrete surface.

The elliptical shape of the body portion 30 of plug 28, that is, the non-round shapes of the plug body portion and the anchor insert eye and the fact that the two are complemental in shape, taken with the stop member function of collar 32, ensures that the passageways 26 will be properly positioned for the receipt of the pins 24.

It will be appreciated that the plate and plug can be conveniently packaged and sold in interconnected condition, i.e. with the pins extending through the passageways of the plug. The tight connection between them prevents any possibility of their accidental disconnection. This ensures that the plug will always be found with the plate in the box or package. The two elements must be disconnected of course prior to insertion of the plug into an anchor insert.

What is claimed is:

1. Closure plate means for the anchor insert recesses of tilt-up concrete wall slabs comprising a plate having front and back faces, pin means projecting rearwardly from the back face of said plate, a connector plug having: a body portion; a stop member portion; and passageway means; said body portion being adapted to fit within the eye of an anchor insert, said stop member portion being adapted to engage the anchor insert and retain the plug within said insert eye, said passageway means being adapted to receive and frictionally engage said pin means and thereby interconnect said plate and said plug.

2. The closure plate means of claim 1, said pin means comprising a pair of spaced parallel pins, and said passageway means comprising a pair of passageways formed in end portions of said plug which are disposed outwardly of said body and stop member portions.

3. The closure plate means of claim 2, said plug body portion being complemental in shape to said eye, and said body portion and said eye being non-round and oriented so that, when said body portion is within said eye, said passageways are disposed in receiving alignment for said pins, said stop member portion being a collar-like flange adapted to engage the anchor insert.

4. The closure plate means of claim 3, said passageways being provided with tapered teeth adapted to have a biting engagement with said pins.

5. In combination with a tilt-up concrete wall slab having an anchor insert embedded therein which is provided with a stem having an oval-shaped eye, a recess formed in said slab around said stem for access to said stem of slab-lifting means, a cover plate fitted over said recess and tightly connected to said slab by connector means comprising a plug fitted within said eye, a stop member on the plug to engage said stem, a passageway formed in said plug, and a pin member carried by said plate and frictionally engaged with said plug within said passageway.

6. The combination of claim 5, including a pair of passageways formed in said plug and a pair of pin members carried by said plate and frictionally engaged with said plug within said passageways.

7. The combination of claim 6, said plug having an oval-shaped body portion non-rotationally fitted within said eye.

8. The combination of claim 7, said stop member being a collar-like flange in engagement with said stem, and said passageways being provided with tapered teeth having biting engagement with said pin members.

* * * * *